US011203848B2

(12) United States Patent
Kunz et al.

(10) Patent No.: US 11,203,848 B2
(45) Date of Patent: Dec. 21, 2021

(54) DIGITAL SPRAY CONTROL SYSTEM

(71) Applicants: James F Kunz, Albuquerque, NM (US); Jeffery Linn, Albuquerque, NM (US); Christopher Barry, Rio Rancho, NM (US); Norman J Redenshek, Albuquerque, NM (US); Randall Raymond Harris, Albuquerque, NM (US); Robert Gaetz, Albuquerque, NM (US); Scott R Wilson, Corrales, NM (US); Timothy M Hoover, Albuquerque, NM (US); Richard J Bando, Albuquerque, NM (US); Joseph Michael Davis, Tijeras, NM (US)

(72) Inventors: James F Kunz, Albuquerque, NM (US); Jeffery Linn, Albuquerque, NM (US); Christopher Barry, Rio Rancho, NM (US); Norman J Redenshek, Albuquerque, NM (US); Randall Raymond Harris, Albuquerque, NM (US); Robert Gaetz, Albuquerque, NM (US); Scott R Wilson, Corrales, NM (US); Timothy M Hoover, Albuquerque, NM (US); Richard J Bando, Albuquerque, NM (US); Joseph Michael Davis, Tijeras, NM (US)

(73) Assignee: MEGA CORP, INC., Albuquerque, NM (US)

( * ) Notice: Subject to any disclaimer, the term of this patent is extended or adjusted under 35 U.S.C. 154(b) by 116 days.

(21) Appl. No.: 14/035,753

(22) Filed: Sep. 24, 2013

(65) Prior Publication Data

US 2014/0084081 A1 Mar. 27, 2014

Related U.S. Application Data

(60) Provisional application No. 61/705,087, filed on Sep. 24, 2012.

(51) Int. Cl.
*E01H 3/02* (2006.01)

(52) U.S. Cl.
CPC ..... *E01H 3/02* (2013.01)

(58) Field of Classification Search
CPC ..... B05B 1/08; B05B 15/00; B05B 9/0423; A01M 7/0089; A01M 7/0053; A01C 7/081; A01C 7/082; A01C 7/084; A01C 7/04

(Continued)

(56) References Cited

U.S. PATENT DOCUMENTS 4,052,003 A 10/1977 Steffen
4,629,164 A * 12/1986 Sommerville ..... 239/69

(Continued)

FOREIGN PATENT DOCUMENTS

CA 1217547 * 2/1987 ..... A01M 7/00
CA 2672510 10/2012
WO WO2002034033 2/2002

*Primary Examiner* — Alex M Valvis
*Assistant Examiner* — Christopher R Dandridge
(74) *Attorney, Agent, or Firm* — Richard E. Oney; Venjuris, P.C.

(57) ABSTRACT

A system for controlling water distribution from a water distribution vehicle includes spray heads for spraying water from the vehicle and an actuator system for turning the spray heads on and off. A computer processor is programmed to control the actuator system in response to a sensor input. The system can include means for measuring the ground speed of the vehicle, such as a GPS, and the sensor input signal can be associated with the ground speed of the vehicle. Using a pulse width modulated signal, the processor can adjust water flow from the spray heads based on the vehicle ground speed. The processor also can be programmed to prevent water flow from one or more spray heads when the vehicle speed is below a minimum speed or as the vehicle speed is reduced.

20 Claims, 10 Drawing Sheets

(58) Field of Classification Search
USPC ..... 239/11, 71, 74, 76, 101, 67, 68, 155, 159, 239/164, 170
See application file for complete search history.

(56) References Cited

U.S. PATENT DOCUMENTS

| | | | | |
|---|---|---|---|---|
| 6,230,091 | B1 * | 5/2001 | McQuinn | 701/50 |
| 7,502,665 | B2 * | 3/2009 | Giles | A01B 79/005 700/241 |
| 7,896,258 | B2 * | 3/2011 | Hoisington | E01C 19/176 239/155 |
| 8,360,343 | B2 | 1/2013 | Gudat et al. | |
| 8,376,244 | B2 | 2/2013 | Anderton et al. | |
| 8,444,062 | B2 | 5/2013 | Anderton et al. | |
| 8,989,919 | B2 * | 3/2015 | Jang | B60R 16/02 701/2 |
| 2009/0078178 | A1 * | 3/2009 | Beaujot | A01C 7/084 111/170 |
| 2009/0192654 | A1 | 7/2009 | Wendte et al. | |
| 2010/0301134 | A1 * | 12/2010 | Anderton | E01H 10/007 239/172 |
| 2013/0037625 | A1 * | 2/2013 | Arenson | A01M 7/0089 239/71 |
| 2013/0200171 | A1 * | 8/2013 | Hartfelder | A01G 25/16 239/1 |
| 2013/0333601 | A1 * | 12/2013 | Shivak | 111/118 |

* cited by examiner

DIGITAL SPRAY CONTROL SYSTEM

RELATED APPLICATION

This application claims the benefit of U.S. Provisional Application No. 61/705,087, filed Sep. 24, 2012, entitled "Digital Spray Control System," which is incorporated herein by reference.

COPYRIGHT NOTIFICATION

Portions of this patent application include materials that are subject to copyright protection. The copyright owner has no objection to the facsimile reproduction by anyone of the patent document itself, or of the patent application as it appears in the files of the United States Patent and Trademark Office, but otherwise reserves all copyright rights whatsoever in such included copyrighted materials.

BACKGROUND

The present invention relates to industrial water distribution vehicles. More particularly, it relates to an automated spray and watering control system for use with industrial water distribution vehicles, such as off-road water trucks typically used to maintain surface conditions in mines, power plants, and construction sites.

Trucks that carry water tanks for spraying water on road surfaces and the like are well known. Many such trucks simply employ a bottom mounted discharge with a gravity feed system for emptying the tanks. Another type of water discharge is with a pressurization system for the water tank. These systems have a number of shortcomings. For example, their operation can result in overwatering, which is inefficient, wasteful and can present safety issues.

It is an object of the invention to provide a method and system for industrial water distribution vehicles that can eliminate waste and overwatering through better utilization of water payloads.

It is yet another object of the invention to enhance safety and operational efficiency by improved watering control.

It is also an object to reduce maintenance and service requirements for the watering system, thereby yielding greater return on investment (ROI).

It is still another object of the invention to improve equipment reliability.

Additional objects and advantages of the invention will be set forth in the description that follows, and in part will be apparent from the description, or may be learned by practice of the invention. The objects and advantages of the invention may be realized and obtained by means of the instrumentalities and combinations pointed out in this specification.

SUMMARY

To achieve the foregoing objects, and in accordance with the purposes of the invention as embodied and broadly described in this document, there is provided a system for controlling water distribution from a water distribution vehicle. The system includes one or more spray heads for spraying water from the vehicle and an actuator system for turning the one or more spray heads on and off. A computer processor is programmed for providing a signal for controlling the actuator system. Control communication can be provided via a computer network data bus, such as a LIN bus. The actuator system can include a hydraulic actuator. The computer processor can automatically provide the signal for controlling the actuator system in response to at least one sensor input signal or in response to a manual input from an operator.

In one preferred embodiment, the system can include means for measuring the ground speed of the vehicle, such as a GPS, and the sensor input signal can be related to the ground speed of the vehicle. The processor is programmed to adjust the water flow from the spray heads based on the vehicle ground speed. In a preferred embodiment, the signal for controlling the actuator and adjusting the water flow can be pulse width modulated. The processor also can be programmed to prevent water flow from at least one of the spray heads when the vehicle speed is below a minimum speed or to prevent water flow from at least one of the spray heads as the vehicle speed is reduced.

According to another feature of the invention, the processor can be programmed to automatically turn off the water pump in response to a sensor signal, such as if a water level in the vehicle water tank is below a minimum level.

BRIEF DESCRIPTION OF THE DRAWINGS

The accompanying drawings, which are incorporated in and constitute a part of the specification, illustrate the presently preferred embodiments and methods of the invention and, together with the general description given above and the detailed description of the preferred embodiments and methods given below, serve to explain the principles of the invention. As will be understood by one of ordinary skill in the art, the figures are not necessarily drawn to scale, and in some instances the drawings have been exaggerated and/or simplified in places for illustrative purposes only.

DETAILED DESCRIPTION

Figure 1:
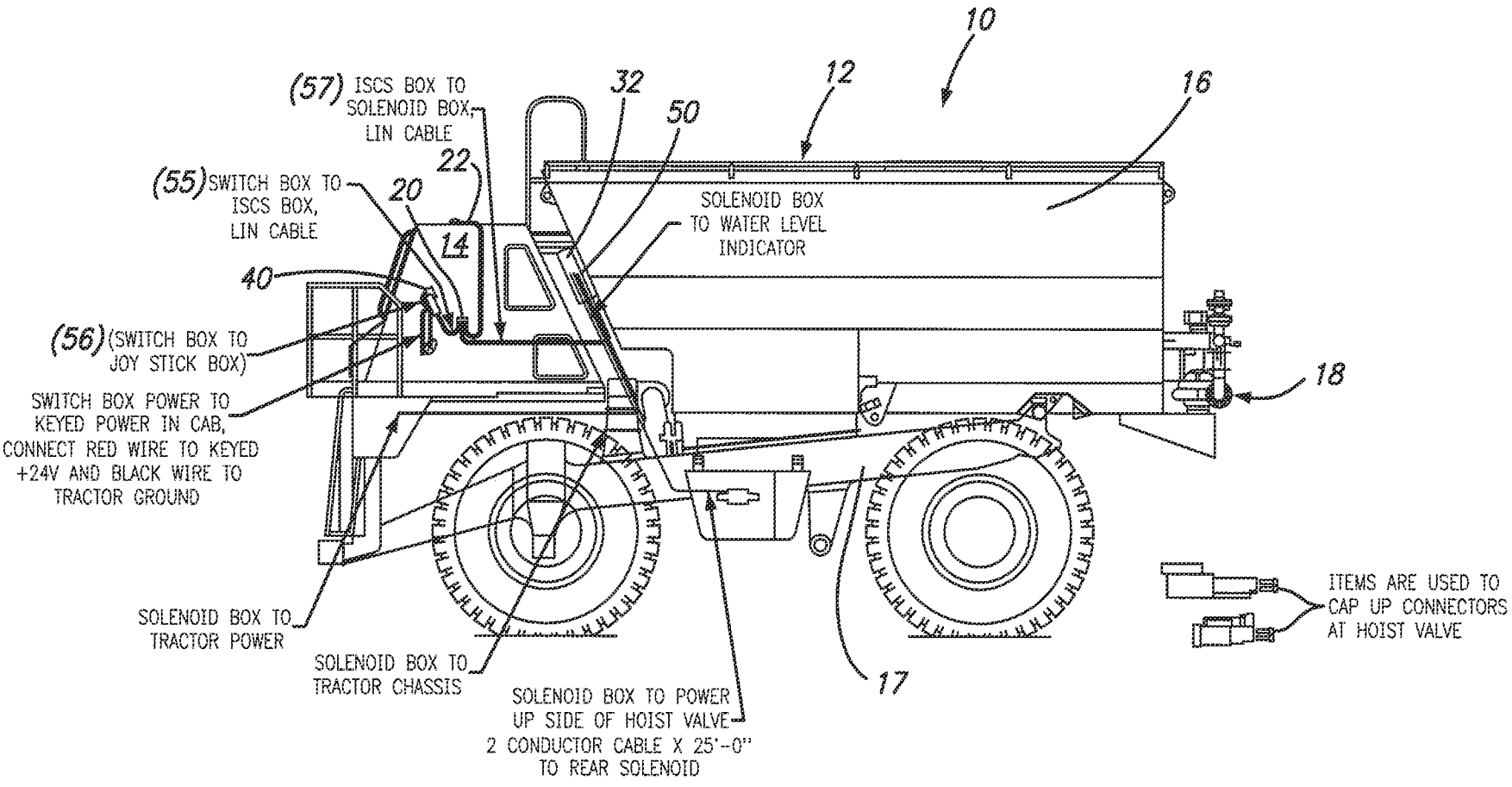
FIG. 1 is a side elevation view of a water truck that is equipped with one exemplary embodiment of a digital spray control system (DSCS) according to the present invention, showing the location of various subassemblies of the system and the electrical and network cabling connecting those elements.

Reference in this application is made to presently preferred embodiments and methods of the invention. While the invention is described more fully with reference to these examples, the invention in its broader aspects is not limited to the specific details, representative devices, and illustrative examples shown and described. Rather, the description is to be understood as a broad, teaching disclosure directed to persons of ordinary skill in the appropriate arts, and not as limiting upon the invention.

Overview

According to the present invention, there is provided an intelligent spray and/or watering control system for use on industrial water distribution vehicles (sometimes referred to in this specification as the "digital spray control system" or "DSCS"). The digital spray control system 10 is designed for, but not limited to, use on off-road water trucks typically used to maintain surface conditions in mines, power plants, and construction sites.

In a presently preferred embodiment, the base system replaces the previous vehicle cab controls with a novel operator interface and digital control system. The base system serves as the foundation for productivity improvements and offers benefits such as:

- Improved Operator Interface—Simplified, smaller form factor for easier mounting inside the operator's cab.
- Integrated Design—Designed to work with time-tested spray system components.
- Pump Protection—Automatically shuts off the water pump when the tank is empty to prevent pump seal and bearing damage.
- Soft Start-Stop—Prevents abrupt start-up and shut-down of the water pump to prolong component life.
- Better Electrical Design—Relocates power wiring outside of the operator's cab leaving only the low-current digital interface in the cab, increasing protection from environmental threats.
- Enhanced Troubleshooting—Allows a technician to quickly isolate and identify problems.

One advantageous embodiment of the system allows the water vehicle operator to automatically control the amount of water applied to road surfaces based on vehicle ground speed. The system 10 works with the existing spray system hardware—water pumps, hydraulic motors, spray heads and electro-hydraulic controls. The system offers the following additional benefits:

- GPS Speed Sensing—The system uses GPS data to determine speed. The GPS system is universal—there is no special application—specific engineering required and the system is not vulnerable to contamination like radar-based systems.
- Self-Contained—The system does not require connections to other vehicle systems to determine speed. Because it is self-contained, it is easy to adapt to a wide variety of machine applications.
- Automatic Water Consumption Reduction—The spray control system utilizes a PWM (pulse width modulation) strategy to automatically limit the amount of water consumed based on vehicle speed while maintaining road dust control coverage. Utilizing the PWM strategy avoids the addition of complex and costly variable flow hydraulic systems and the resulting impact on machine reliability.
- Automatic Shut-Off—The system automatically shuts off the flow of water as the vehicle comes to a stop to prevent puddling. Spraying automatically resumes as the machine begins to move again.
- Fail-Safe—In the event the system loses its GPS speed signal or otherwise malfunctions, the system reverts to manual mode and allows the machine to continue operating with full capability in the original, manual mode until repairs can be made—no need to immediately down the machine.
- Versatility—The system is adaptable to existing water equipment and can be easily added in the field to machines originally equipped with the base system described above. The control system can be retrofitted to many older models of water distribution equipment equipped with existing spray systems without replacing any hardware.
- Reliability—The system can utilize existing water pump, hydraulic motors, spray heads and electro-hydraulic controls. There are no complex modifications to the vehicle's hydraulic systems or power-train—in fact these interfaces need not change at all. The spray system components can be maintained with all of the same parts supply, technical support and documentation.

Figure 2:
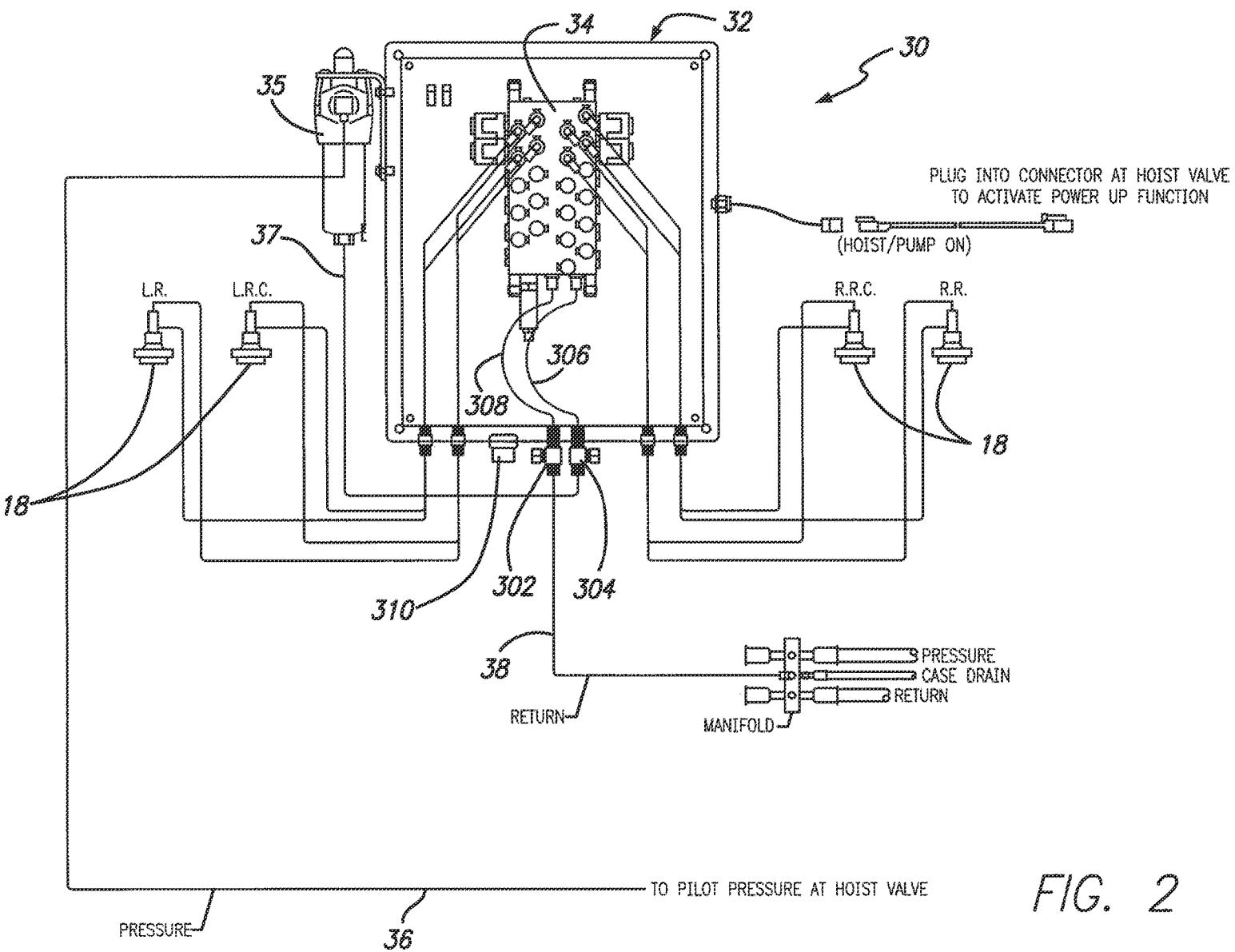
FIG. 2 is a schematic diagram of the hydraulic control circuit for the digital spray control system of FIG. 1, showing a solenoid box assembly including a hydraulic manifold coupled via hydraulic lines to four spray heads.

Referring to FIGS. 1-2, a system 10 according to the present invention can be installed in an industrial water truck 12, which typically includes a cab 14 and a water tank 16 mounted on a chassis 17, and a plurality of spray heads 18, as are previously known in the art. A hydraulic control circuit 30 directs the flow of hydraulic fluid to operate the valves, spray heads, pumps, etc. for distributing water from the water tank 16.

Figure 7:
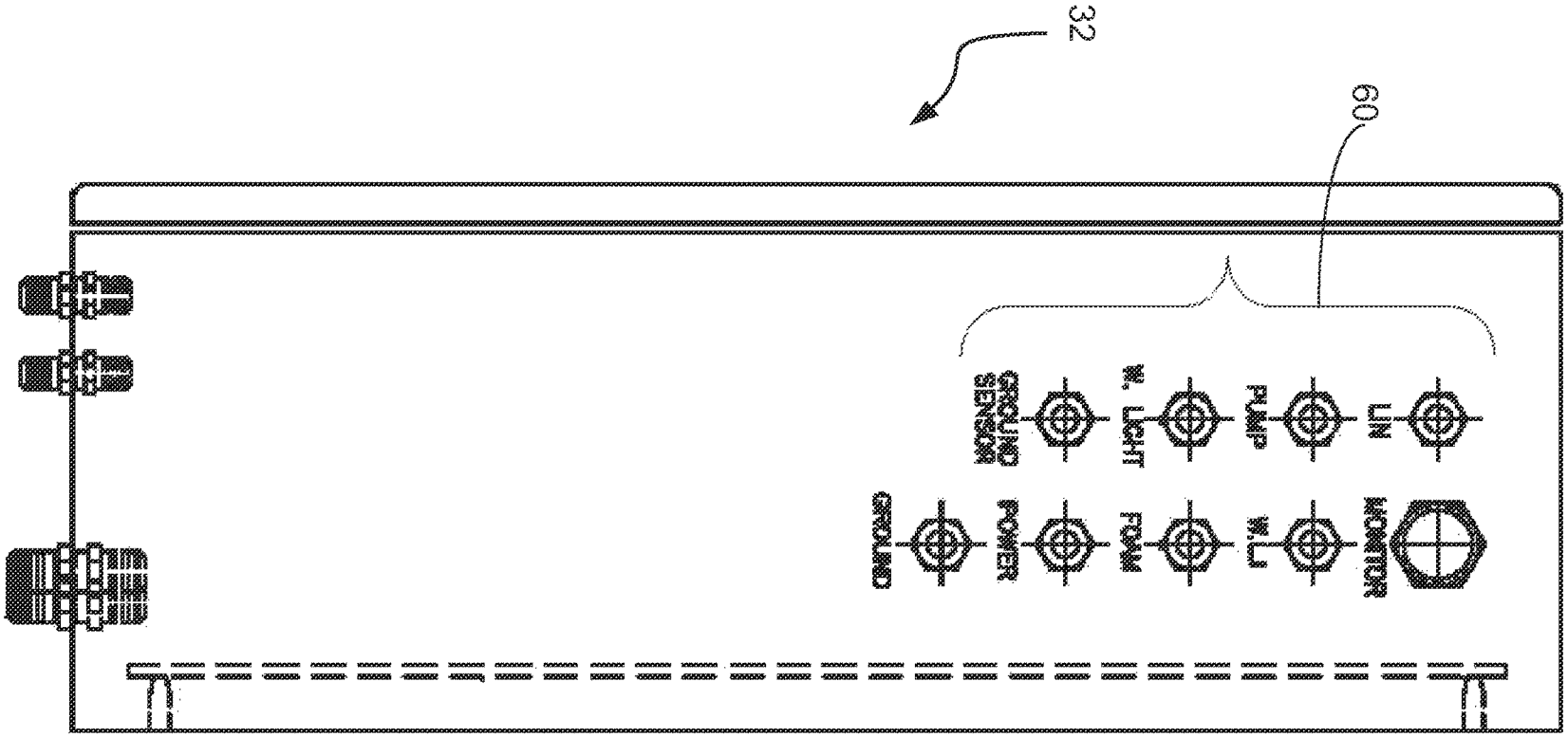
FIG. 7 is a right side elevation view of the solenoid box assembly of FIG. 5, showing the electrical connectors for the box.
Figure 8:
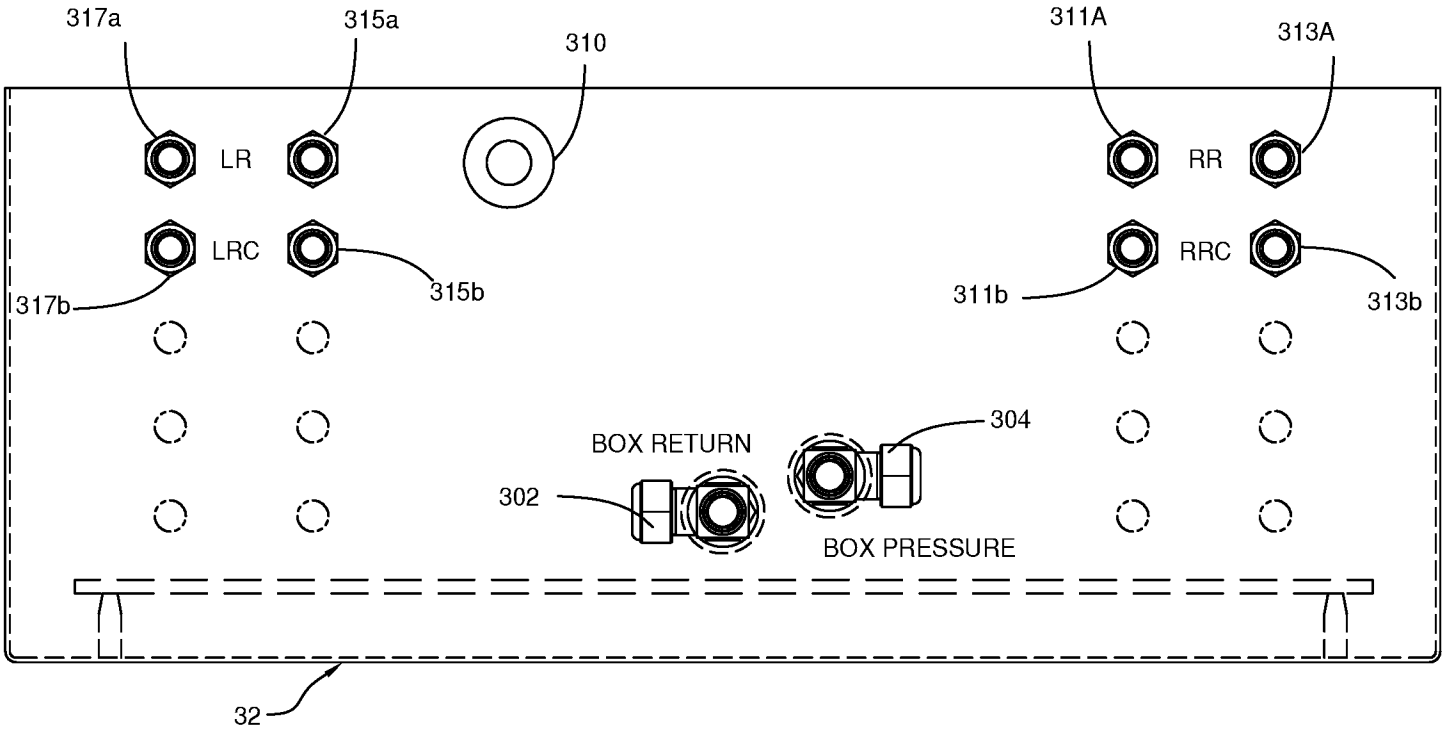
FIG. 8 is a bottom plan view of the solenoid box assembly of FIG. 5, showing the hydraulic line connectors for the box.

As can be seen in FIGS. 2 and 5-8, the hydraulic control circuit 30 includes a solenoid box 32, which encloses a hydraulic control manifold 34. The hydraulic manifold includes valves, which control the flow of hydraulic fluid to the spray heads 18 for opening and closing them. The circuits of the hydraulic control manifold 34 are connected to the spray heads via hydraulic control lines 312, 314, 316, 318 and hydraulic line connectors 311, 313, 315, 317 located in the bottom of the solenoid box 32. The manifold valves are actuated by solenoids controlled by power controllers 50, as described in more detail below. Electrical connectors 60, as shown in FIG. 7, are provided for electrically connecting the solenoid box 32 to the system network and components/hardware. In the embodiment shown, the system 10 has four spray heads 18 located at the left rear (L.R.), left rear center (L.R.C.), right rear (R.R.) and right rear center (L.R.C.) of the water truck 12. The hydraulic control circuit 30 includes a pressure line 36 coupled to a filter 35 for filtering hydraulic fluid. A filter output line 37 is coupled to the manifold 34 via a box pressure connector 304 and a manifold pressure line 306. A hydraulic a return line 38 is coupled to the manifold 34 to via a box return connector 302 and a manifold return line 308. In the bottom of the solenoid box 32 is a condensation drain 310.

Figure 3:
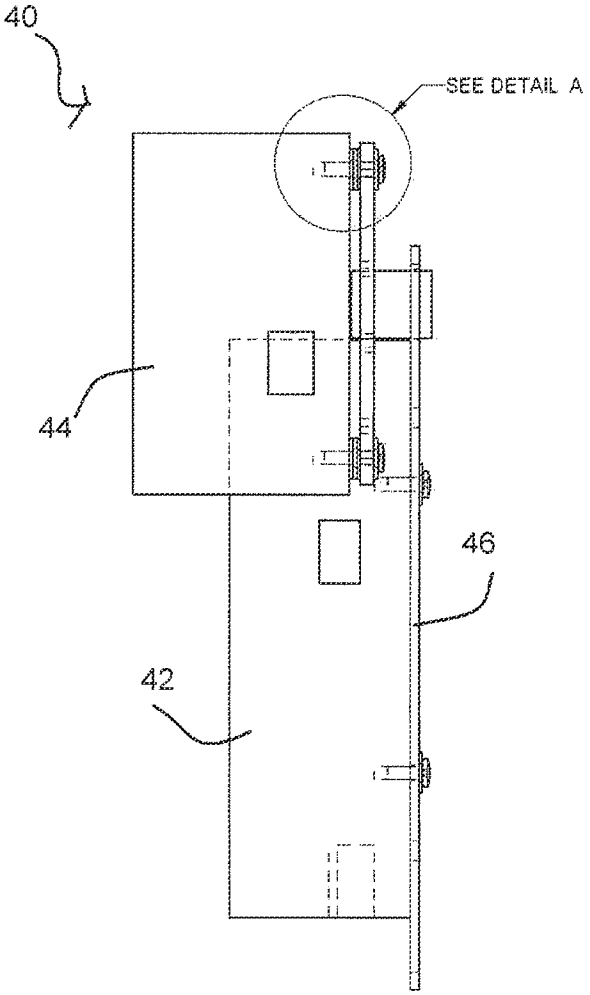
FIG. 3 is a side elevation view of the control box assembly of the digital spray control system of FIG. 1, showing a switch box and joy stick box mounted to a mounting plate.
Figure 4:
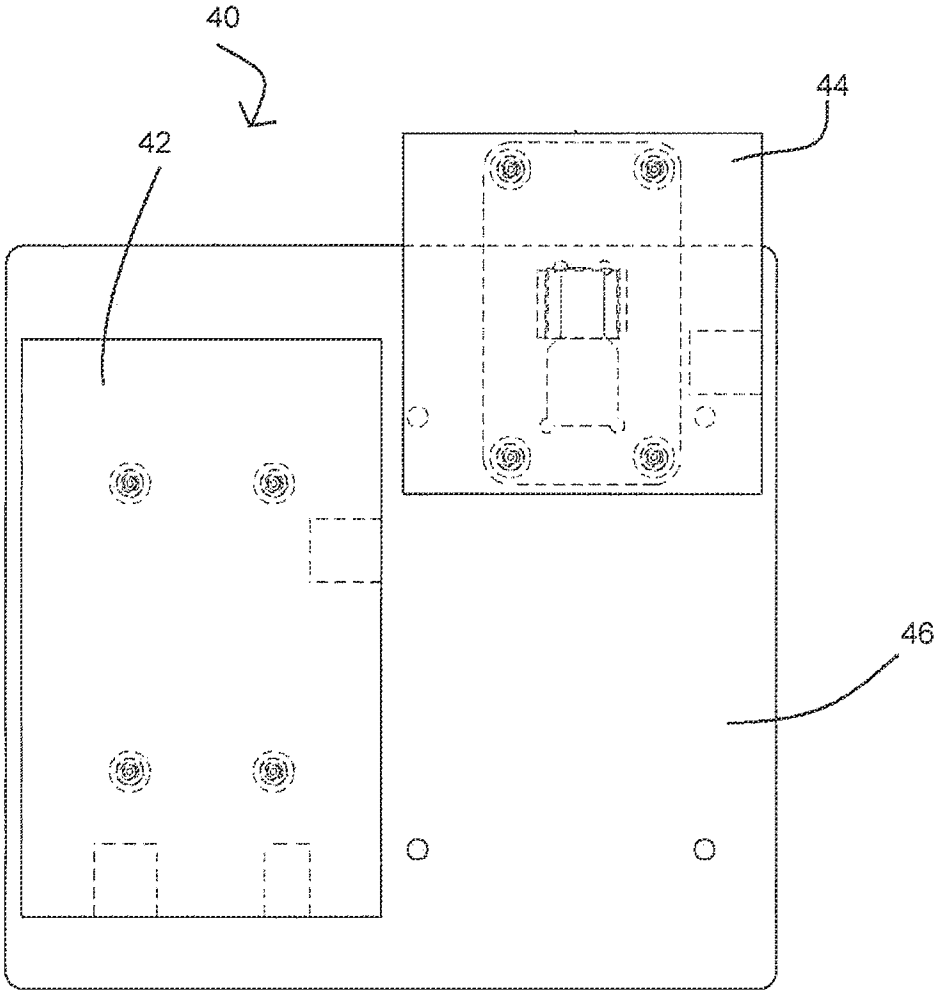
FIG. 4 is a front elevation view of the control box assembly of FIG. 3.
Figure 6:
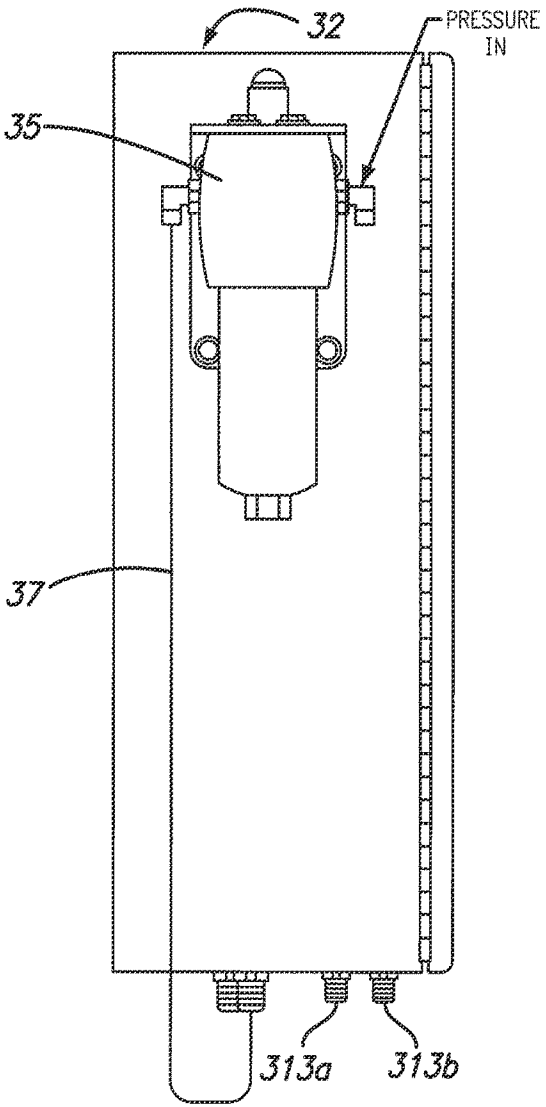
FIG. 6 is a left side elevation view of the solenoid box assembly of FIG. 5.
Figure 5:
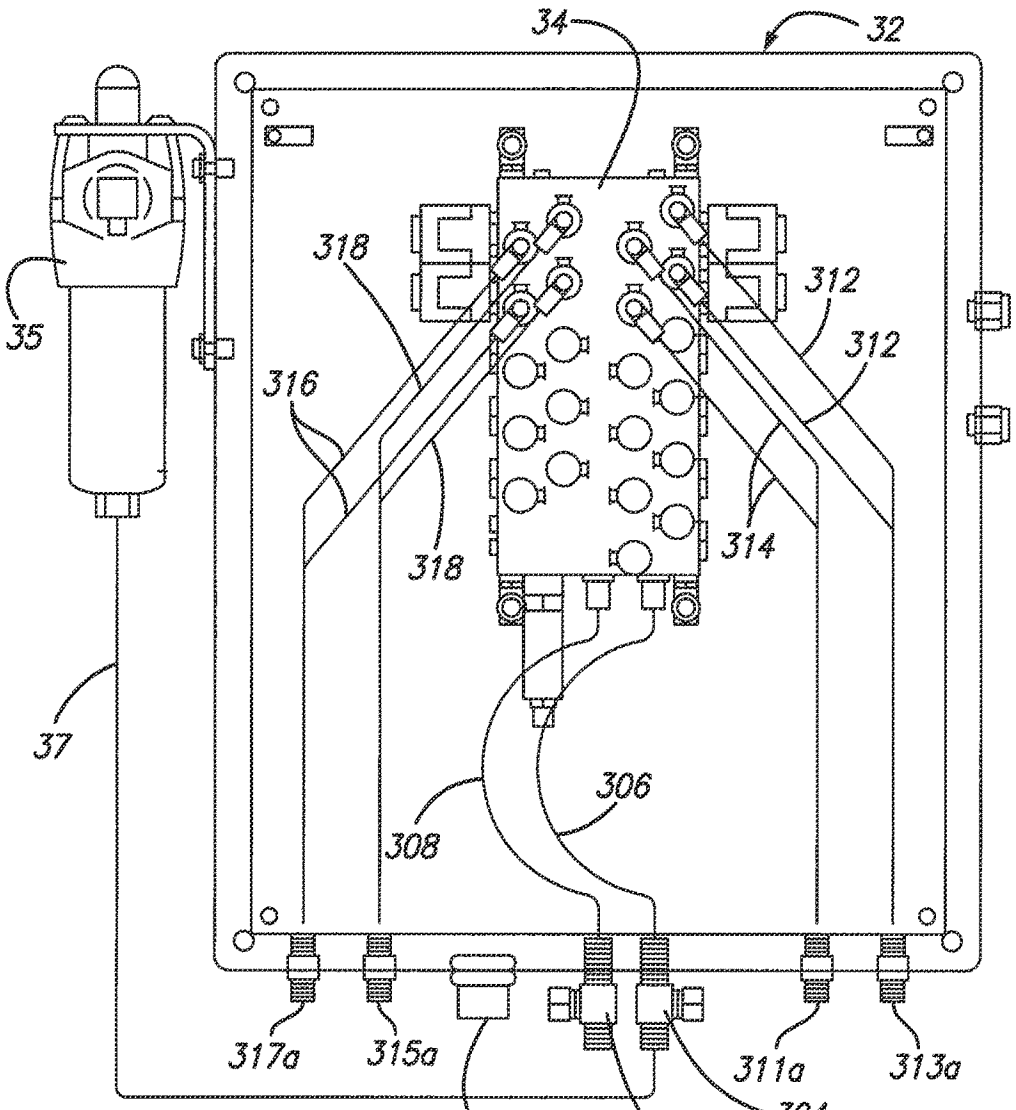
FIG. 5 is a front elevation view of the solenoid box assembly of the digital spray control system of FIG. 1, with the cover removed and showing the hydraulic manifold and hydraulic line connections inside the box.
Figure 12:
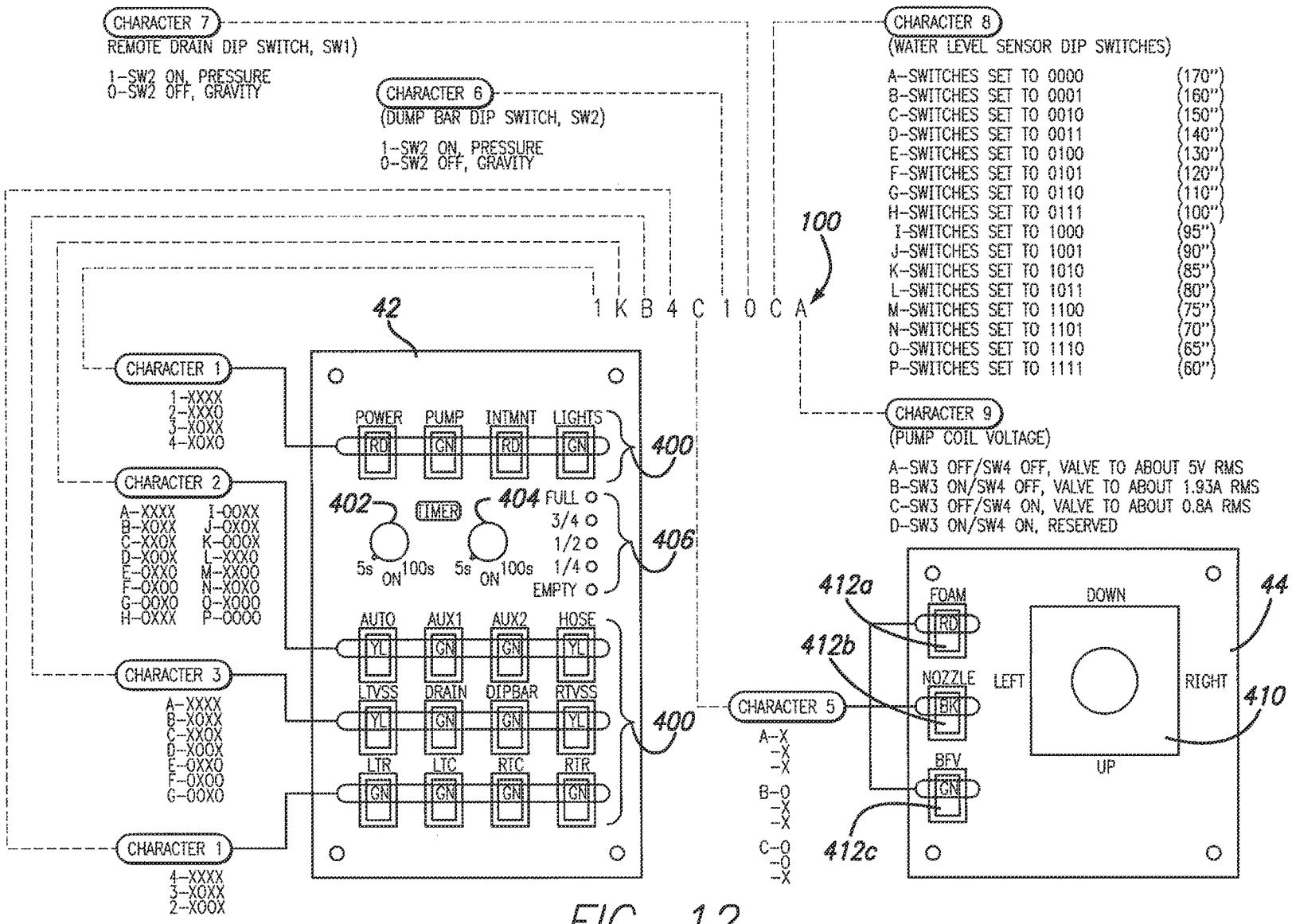
FIG. 12 shows a diagram of exemplary settings for DIP switches in the switch box and joy stick box for selecting various system functional options.

Referring to FIGS. 3-4 and 12, a control box assembly 40 is mounted inside the truck cab 14 where it is readily accessible to an operator. The control box assembly 40 serves as the user interface (UI) or human-machine interface (HMI) for operating the digital spray control system 10. Various switches, indicators, and potentiometers can be disposed on the control box assembly for operating the system 10. As shown in FIGS. 3-4 and 12, in one embodiment, the control box assembly 40 includes a switch box 42 and a separate joystick box 44, both of which are mounted to a mounting plate 46. The switch box 42 includes rocker switches 400 as shown in detail in FIG. 12. The joystick box 13 includes a joystick control 410 and rocker switches 412 for operating a water cannon (not shown).

System Network Architecture

The system network is designed around automotive microprocessor and control network technology. An automotive control network serves as a backbone over which a master node can issue commands and retrieve responses from a number of network slave nodes including user interfaces, human-machine interfaces, power control units, and sensor interface units. In one preferred embodiment, a Local Interconnect Network (LIN) bus is used with the digital spray control system 10. LIN is a low-speed and inexpensive serial protocol network loosely based on the well-known Controller Area Network (CAN). In a presently preferred embodiment, the digital spray control system 10 uses cables for connecting network nodes, but it will be understood that other suitable means of establishing communication between devices can be used, including for example fiber optics, infrared, Radio Frequency (RF), wireless, Wi-Fi and Bluetooth.

The choice of the LIN bus for the control network bus minimizes installation costs. A 3- or 4-wire shielded cable can be used to provide the communications between the nodes as well as the control power to the nodes themselves. Heavy loads (such as the solenoids and coils) draw power directly from the power source via cables entirely separate from the LIN bus. The number and size of conductors that must be used to interface the digital spray control system 10 to the devices on the vehicle is reduced by this approach.

Figure 10:
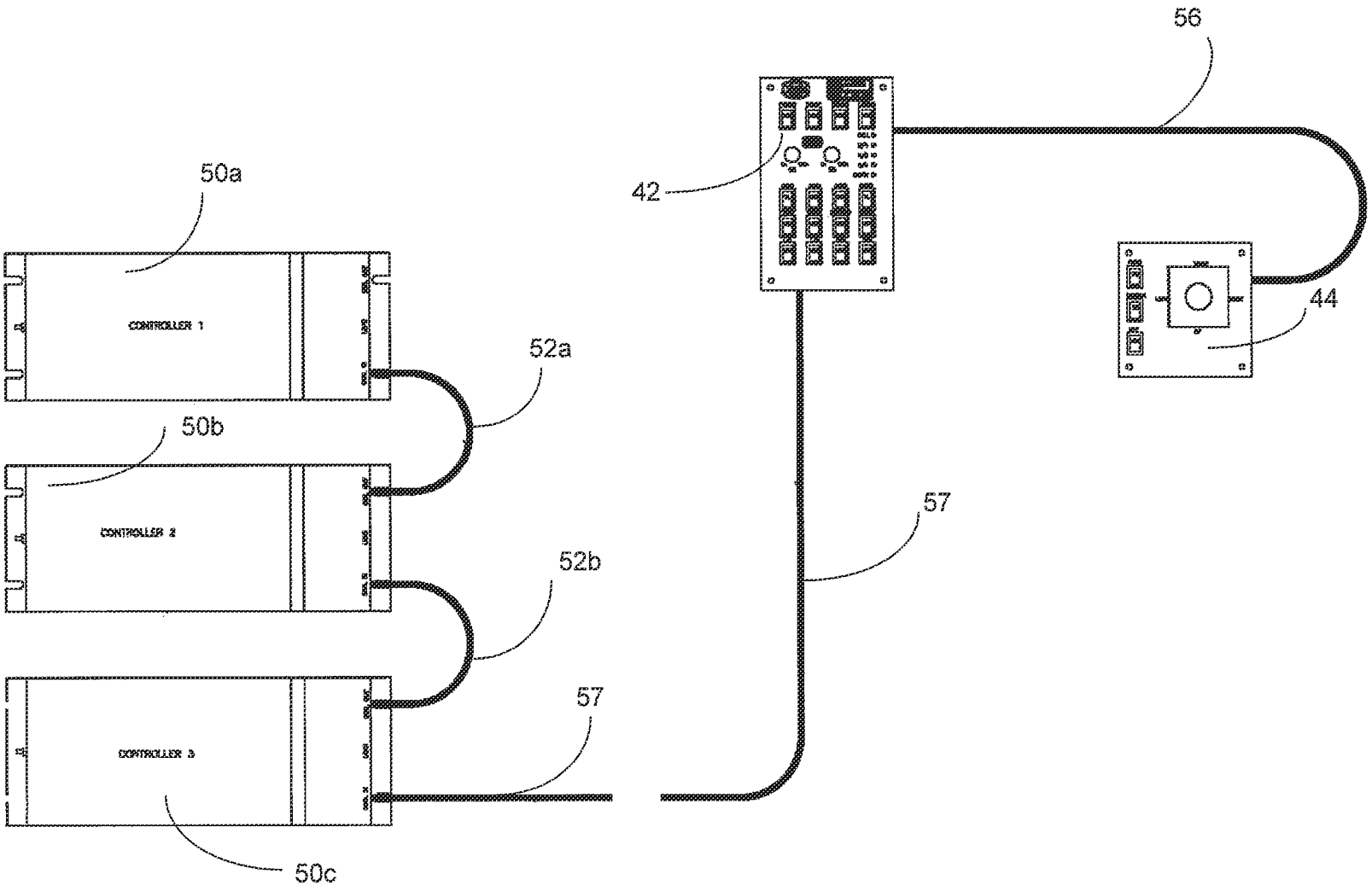
FIG. 10 is a schematic diagram of the Local Interconnect Network (LIN) cable connections for the digital spray control system of FIG. 1, showing the network cable connections for the controller boxes, switch box and joy stick box.
Figure 11:
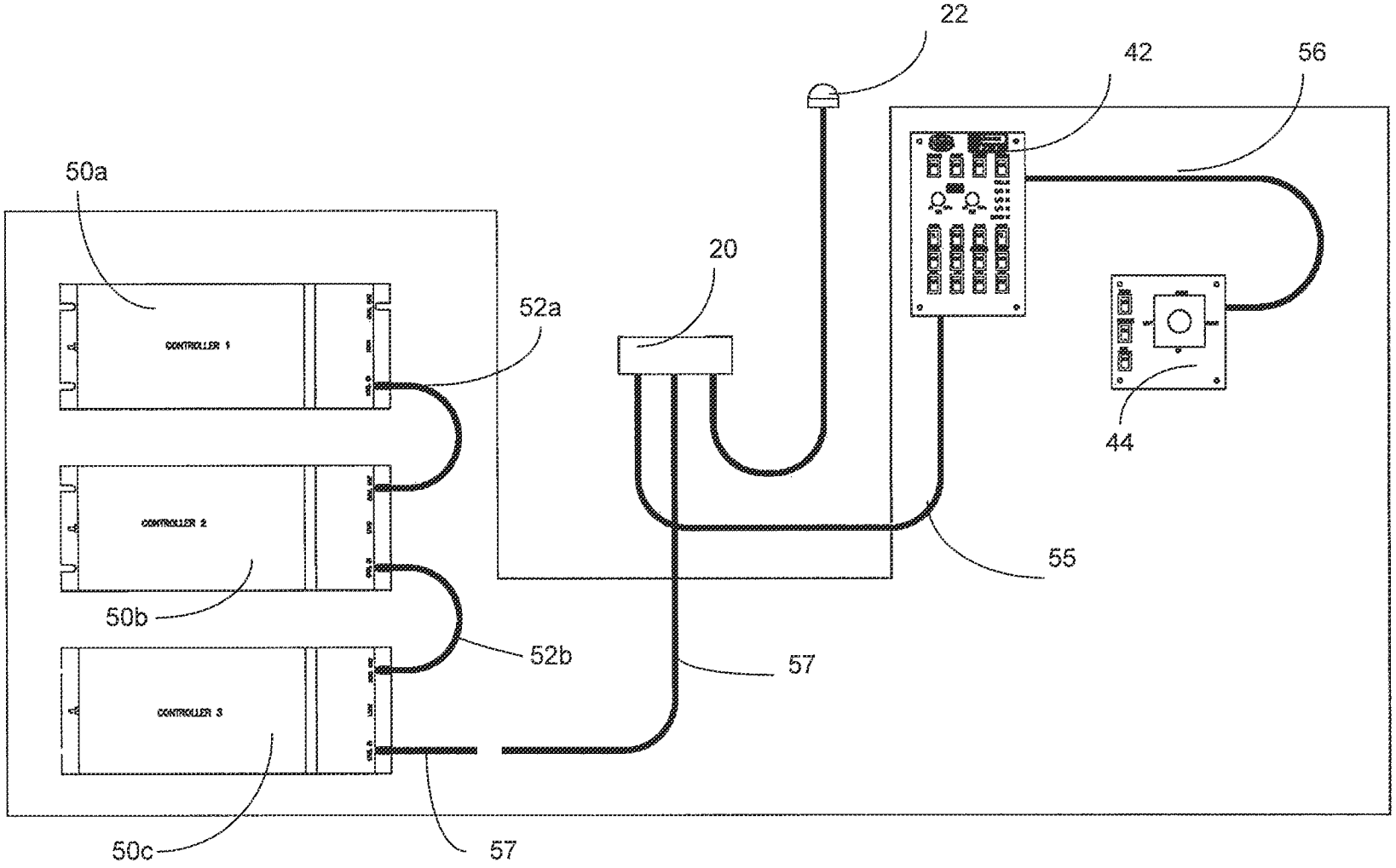
FIG. 11 is a schematic diagram of the LIN cable assembly connections for an embodiment of the digital spray control system that includes an Intermittent Spray Control System (ISCS) option, which shows the network cable connections among the controllers, the ISCS enclosure, a GPS assembly, the switch box and the joystick box of the system.

Referring to FIGS. 10-12, in one preferred embodiment, the switchbox 42 encloses the LIN master node, which includes a microprocessor and suitable data storage for storing the algorithms that determine how the system responds to the various UI elements and controls, schedules reading and updating of the sensors and power controllers, and serves as the master for the LIN bus. A CAN bus interface is also available in the master node should it be required. The switchbox 42 also includes a slave I/O board, which monitors and controls all elements of the UI. The slave I/O board has its own microprocessor and is configured as a slave node on the LIN bus. A short LIN bus segment internally connects the master node and the switchbox slave I/O node. The joystick box 13 also includes a slave I/O board, with its own microprocessor, as a slave node on the LIN bus to control the joystick 410 and related switches 412 and indicators. The joystick box 44 is connected to the switchbox 42 via a LIN cable 56. Although a joystick is included in a presently preferred embodiment (to control a water cannon), the use of a joystick is not a requirement; the system can support many other types of commonly used UI devices.

Figure 9:
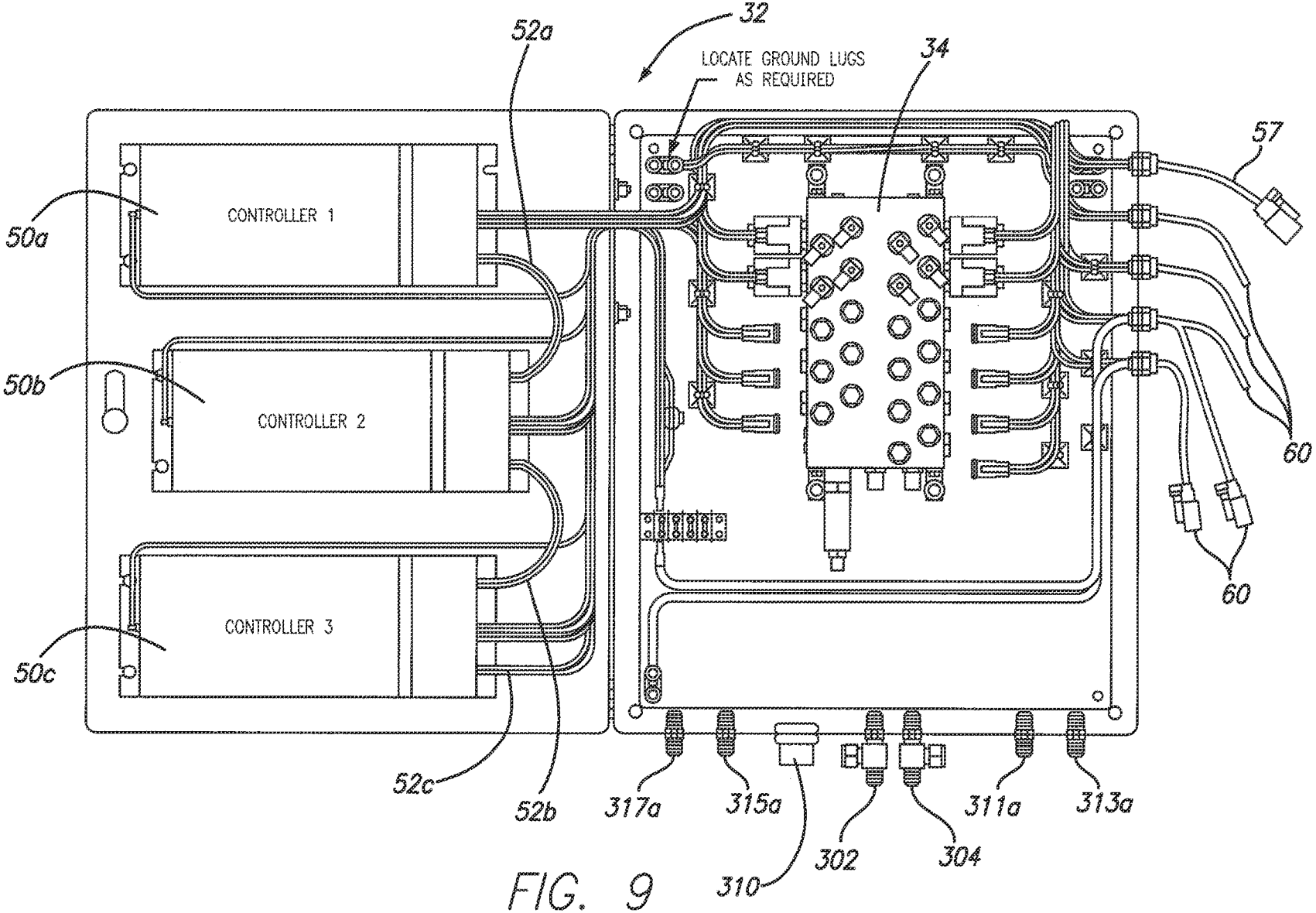
FIG. 9 is a front elevation view of the solenoid box assembly of FIG. 5 with the hinged cover open, showing the controllers and the electrical wiring connections between the controllers and the hydraulic manifold.

Referring to FIGS. 9-11, the power controllers 50 serve as switching devices that energize the coils and solenoids in the water truck 12. These coils and solenoids direct the flow of hydraulic fluids to operate the system valves, spray heads, pumps, etc. of the system 10. The power controllers 50 are serially connected to the LIN bus via LIN cables 52, 57. Each controller 50 serves eight (8) channels (e.g., a coil or solenoid) and switches fast enough to perform pulse width modulation (PWM) control of the controlled device. The PWM control feature performs time-based ramping of the water pump control valve to reduce mechanical stress, increase product lifetime, reduce maintenance costs, and improve reliability. In a preferred embodiment, each power controller 50 can also receive inputs from one or more analog devices. In this configuration, for example, the system can provide a water level sensing feature using an analog pressure transducer. Arrangement of the power controllers 50 allows for switching power to a device and monitoring for the presence of power at the controlled device (e.g., a solenoid coil). As part of normal operation, the master node receives a report on the status of the power at the device. This capability allows the master node to provide better indication to the operator of the state of the outputs and additionally provides basic diagnostic feedback to the operator.

Each power controller 50 exists as a slave node on the LIN bus, complete with its own microprocessor. If no LIN bus activity is detected by the microprocessor for a certain length of time, then the power controller 50 will time out and turn off power to the outputs. This prevents outputs from remaining energized if the master node should fail or in cases of lack of network connectivity (i.e., physical damage to cables, faulty LIN nodes, etc).

Referring to FIG. 9, in a preferred embodiment, the digital spray control system 10 includes three power controller nodes 50*a*, 50*b*, 50*c*. The number of these nodes is limited only by the limitations of the LIN bus (or other bus used to implement the DSCS network). The power controllers 50 use solid-state relay type devices for energizing various system hardware devices, although it will be understood that other known vehicle or industrial control or sensor interface devices can be used, such as servo controls, analog I/O modules, 4-20 ma loops, or any other common vehicle or industrial control or sensor interface.

Referring to FIG. 11, in one preferred embodiment of the system 10, a LIN slave node (ISCS node) 20 is serially connected to the LIN bus via LIN cable 57 and serves as a means of communication with a GPS receiver 22. The ISCS node 20 provides information to the master node in the switch box 42 regarding the vehicle ground speed and location. This data can be used to implement advanced control algorithms, such as vehicle speed compensation, adaptive or automatic water application rate control, automatic water conservation procedures, metering or tracking of water application rate or location. Implementation of many other applications to suit the requirements of the job also can be achieved.

Upon reading this specification, it will be understood by those of skill in the art that slave nodes for other types of devices can be implemented as needs arise because of the flexibility of the modular network design of the system 10. For example, the network design will allow for the inclusion of data display units, touch screen interfaces, video or camera interfaces, soil monitoring devices, pattern recognition units, autonomous operation units (for vehicle operation), radio and telemetry devices, and many other devices used in operations where the digital spray control system might be applied.

System Operation

Referring to FIG. 12, with the digital spray control system 10, an operator can use the switch box switches 400 to turn on and off the various spray heads (LTR, LTC, RTC, RTR), pump (PUMP), and work lights (LIGHTS) in a manual mode. An intermittent spray mode switch (INTMNT) allows the operator to manually adjust the duty cycle and period of the spray heads on a timed basis (independent of vehicle speed) using a Rate knob 402 and a Speed knob 404, as described below. An automatic mode (AUTO) is also provided that allows the operator to control the water application rate as a function of the truck speed, with the digital spray control system 10 managing the timing and operation of the spray heads 18 within the limitations of the pump and spray heads (with interaction to the vehicle drive train and hydraulic system). Water level indicator lights 406 indicate the water level in the water tank 16.

The digital spray control system 10 implements a number of features that are designed to improve the cost of ownership. Some of these features are:

(1) Automatic shutdown of the water pumps if the water level should fall too low, which prevents damage to the pump and seals, improves reliability, and reduces maintenance costs;

(2) A timeout mechanism that triggers automatic shutoff of the water pump if no water is being drawn through the pump, which prevents damage to the pump and seals, improves reliability, and reduces maintenance costs;

(3) Automatic shutoff of the spray heads when the vehicle speed is below a certain threshold, which economizes on the use of the water in the tank and prevents ponding or pooling near stopping points and congested areas;

(4) Fail over of the digital spray control system to manual mode if the GPS system should fail for any reason, which permits the vehicle to remain in service, with reduced functionality, while the GPS system is diagnosed and repaired; and (5) Reduction in the number of spray heads that are turned on as a function of vehicle speed happens automatically, which allows the flow rates and spray patterns of the heads to be used most effectively as a function of the vehicle speed while preserving as much as possible the desired water coverage pattern.

Still referring to FIG. 12, additional features implemented by the digital spray control system 10 permit the same hardware to be used in a number of different vehicle configurations:

(1) A table of water tank pressures can be stored in the master node, with a set of switches used to select entries in the table corresponding to the various water tank configurations. This feature permits the same hardware and firmware to be used across a wide range of water tanks;

(2) Configuration switches can be provided to permit inclusion or exclusion of certain devices from being monitored by the automatic pump shutoff capability. This feature permits the use of both gravity- and pump-powered drains (DRAIN) and dump bars (DMPBAR or DIPBAR); allowing the same hardware and firmware to be used across multiple product lines; and (3) Switches on the front panel can be installed or removed to selectively disable or enable control of various devices. This feature permits the same basic hardware and firmware to service differing vehicle configurations, such as support for a hose reel (HOSE).

The automatic (AUTO) mode is a feature of the digital spray control system 10 that uses ground speed feedback to continuously adjust the duty cycle and period of the sprayed pulses of water applied to the surface in accordance with the desires of the operator. In a presently preferred embodiment, this ground speed feedback is implemented by GPS. It also can be implemented, however, by other suitable means for sensing ground speed, such as radar, laser, shaft or transmission sensors, etc. In one embodiment, the auto mode is implemented by splitting the vehicle speed into various ranges where varying behaviors are applied:

(1) Below a minimum speed (Vmin), water flow is cut off by closing the spray heads;

(2) Above a certain speed (Vfull), all spray heads requested by the operator are fully open on a continuous basis;

(3) Below Vfull, but above a second speed threshold (Vreduced) a reduced set of the spray heads are open on a continuous basis; and (4) Between Vmin and Vreduced, the requested spray heads (or a reduced set of them) are pulsed in a PWM fashion. The period is controlled by the vehicle speed. The duty cycle is controlled by a combination of vehicle speed, with the Rate knob 402 and the Speed knob 404 on the switch box 42. The Speed knob 402 is used to set the vehicle speed at which the requested spray heads all turn on with continuous (non-pulsed) flow. The Rate knob 402 is used to control how rapidly the duty cycle is increased with increasing vehicle speed when the vehicle is moving slower than the speed set by the Speed knob 404. By appropriate selection of the Rate and Speed settings, an operator can address a wide range of watering requirements. Watering requirements not met by the AUTO mode can be handled using the standard manual or intermittent modes.

An advantageous feature of the system 10 is the parameterization of the Rate knob 402 and Speed knob 404. This feature helps to simplify the operation of the system. There are many ways that the two knobs can be used, well known to persons skilled in the art of human-machine interfaces. This approach provides some key benefits:

(1) Increasing Rate is strongly related to increasing time on (TON), which is a well known and understood parameter currently in use; and (2) Increasing Speed is generally correlated to increasing time off (TOFF), which is also a well known and understood parameter currently in use.

According to another aspect of the system 10, pulsed (PWM) control of the spray heads can be combined with intelligently turning off some requested spray heads as the vehicle speed is reduced. Using the spray heads this way significantly compensates for engine RPM induced changes in water pump and spray head performance without requiring expensive and troublesome variable speed pumps/variable flow spray heads. This is expected to provide tangible ROI benefits to the customer.

Exemplary Pin-Out Tables

Tables 1-3 below show pin out information for controller output load connections to various devices in an exemplary embodiment of the digital spray control system 10 using three controllers 50*a*, 50*b*, 50*c*.

The device to be actuated should be connected from the given pin to ground. The +24VDC will appear on the output when the device is to be turned on. At other times the output pin will be unpowered and will show a resistance of several thousand ohms to ground. Pin number references are for a Deutsch DT13-12PA connector housing, which is a 12-pin connector.

Regarding the +24VDC power to the controllers 50, it is possible for each of the controllers 50 to supply up to 16 amps of current to the connected loads if all loads are turned on simultaneously, each controller can supply a total of about 16 amps. With three controllers in operation, a maximum of 48 amps must be supplied by the +24VDC power bus. The cable carrying the +24VDC power should be sized appropriately for this current, taking into account the length of the power cable and voltage drop due to the resistance of the wire in the cable. This should be done to provide proper operation and prevent overheating in the power cable. Preferably, the power cable is protected by a fuse or circuit breaker at the power source connection.

Regarding +24VDC load power pins on the controllers 50, if the power pins are too small to individually carry the required current, multiple pins can be used to obtain the required current capacity. It is preferable to run wires from the pair of pins together from each controller to the power bus and connect than to the power bus, rather than to tie them together at the connector and run a single wire to the power bus. For example, the two red wires for +24VDC (pins 9, 12) can be run from controller #1 together over to the +24VDC power bus, tied together with a crimp lug at the power bus, and make the connection to the power bus with the crimp lug (could also install individual crimp lugs, then attach the two crimp lugs to the power bus). This should be done separately for each controller (i.e. don't daisy chain the +24VDC from connector to connector and then tie the end of the chain to the +24VDC power bus). This helps to prevent the wires from being overloaded and also to eliminate excessive voltage drops/noise on the loads when various devices are turned on/off.

TABLE 1

Controller #1

| Pin # | Description | Name | Wire color | Type | Notes |
|---|---|---|---|---|---|
| 1 | Output #1 | BFV ON | Gray | On/Off | |
| 2 | Output #2 | LTVSS | Gray | On/Off | |
| 3 | Output #3 | LTR | Gray | On/Off | |
| 4 | Output #4 | LTC | Gray | On/Off | |
| 5 | Output #5 | RTC | Gray | On/Off | |
| 6 | Output #6 | BFV OFF | Gray | On/Off | |
| 7 | Output #7 | RTVSS | Gray | On/Off | |
| 8 | Output #8 | RTR | Gray | On/Off | |
| 9 | +24 supply | Power in | Red | max 15 | for channels 1-4 |
| 10 | Analog input #1 | Level sensor input | White | 0-10 VDC in | |
| 11 | Analog input #2 | | N/C | 0-10 VDC in | |
| 12 | +24 supply #2 | Power in | Red | max 15 amps | for channels 5-8 |
| Ground lug | Return | Ground | Brass machine screw | Return for +24 power | Run separately from each controller to ground lug to prevent ground loops. |

TABLE 2

Controller #2

| Pin # | Description | Name | Wire color | Type | Notes |
|---|---|---|---|---|---|
| 1 | Output #1 | LIGHTS | Blue | On/Off | Combined channel |
| 2 | Output #2 | LIGHTS | Blue | On/Off | Combined channel |
| 3 | Output #3 | LIGHTS | Blue | On/Off | Combined channel |
| 4 | Output #4 | LIGHTS | Blue | On/Off | Combined channel |
| 5 | Output #5 | DRAIN | Gray | On/Off | |
| 6 | Output #6 | DMPBAR | Gray | On/Off | |
| 7 | Output #7 | AUX1 | Gray | On/Off | |
| 8 | Output #8 | PUMP | Gray | PWM | Ramps up/down |
| 9 | +24 supply #1 | Power in | Red | max 15 amps | for channels 1-4 |
| 10 | Analog input #1 | | N/C | 0-10 VDC in | |
| 11 | Analog input #2 | | N/C | 0-10 VDC in | |
| 12 | +24 supply #2 | Power in | Red | max 15 amps | for channels 5-8 |
| Ground lug | Return | Ground | Brass machine screw | Return for +24 power | Run separately from each controller to ground lug to prevent ground loops. |

TABLE 3

Controller #3

| Pin # | Description | Name | Wire color | Type | Notes |
|---|---|---|---|---|---|
| 1 | Output #1 | NOZZLE A | Yellow | On/Off | |
| 2 | Output #2 | NOZZLE B | Yellow | On/Off | |
| 3 | Output #3 | LEFT | Yellow | On/Off | |
| 4 | Output #4 | FOAM ON | Yellow | On/Off | |
| 5 | Output #5 | DOWN | Yellow | On/Off | |
| 6 | Output #6 | UP | Yellow | On/Off | |
| 7 | Output #7 | FOAM OFF | Yellow | On/Off | |
| 8 | Output #8 | RIGHT | Yellow | On/Off | |
| 9 | +24 supply #1 | Power in | Red | max 15 amps | for channels 1-4 |
| 10 | Analog input #1 | | N/C | 0-10 VDC in | |
| 11 | Analog input #2 | | N/C | 0-10 VDC in | |
| 12 | +24 supply #2 | Power in | Red | max 15 amps | for channels 5-8 |
| Ground lug | Return | Ground | Brass machine screw | Return for +24 power | Run separately from each controller to ground lug to prevent ground loops. |

Table 4 below shows pin out information for a water level sensor an exemplary embodiment of the digital spray control system 10.

TABLE 4

Water level sensor (pigtails)

| Pin # at sensor | Description | Wire color | Destination | Notes |
|---|---|---|---|---|
| 1 | +24 VDC power in | Red | Fused +24 VDC in electrical box | Fuse approx 0.25 amps. Sensor requires only 10ma. |

TABLE 4-continued

| Water level sensor (pigtails) | | | | |
|---|---|---|---|---|
| Pin # at sensor | Description | Wire color | Destination | Notes |
| 2 | Common | Black | Ground in electrical box | Attach directly to ground lug to minimize noise |
| 3 | Signal 0-10 VDC | White | Controller #1 pin 10 | |

Table 5 below shows pin out information for LIN bus cables in an exemplary embodiment of the digital spray control system 10.

TABLE 5

| LIN bus cables<br>These are all pin-to-pin (i.e., pin 1 at one end goes to pin 1 at the other end, etc). | | | |
|---|---|---|---|
| Pin # at sensor | Description | Wire color | Notes |
| 1 | Battery | Red | Control power is carried to all LIN bus nodes via this wire |
| 2 | LIN data | White | |
| 3 | Ground | Black | |
| 4 | Shield | Drain | Connected at only one end to prevent ground loops. Doesn't matter which end. |

Table 6 below shows pin out information for a switch box power cable in an exemplary embodiment of the digital spray control system 10.

TABLE 6

| Switch Box Power Cable | | | |
|---|---|---|---|
| Pin # | Description | Wire color | Notes |
| 1 | +24 VDC | Red | From switched vehicle +24 VDC. Should be fused at around 2 amps. This pin supplies power to the control system only |

TABLE 6-continued

| Switch Box Power Cable | | | |
|---|---|---|---|
| Pin # | Description | Wire color | Notes |
| | | | (via the LIN bus cables). Load power comes from pins 9 and 12 on each of the controllers. |
| 2 | Ground | Black, drain | |

Exemplary Switch Setting Configurations for Firmware

As shown in FIG. 12, in one embodiment of the digital spray control system 10, its behavior can be modified using a DIP switches installed on the master board inside the switchbox 32, which are used to set a reference code 100 for setting system configuration options (CHARACTERS 1, 2, 3, 4, 6 and 7). A four-way DIP switch (CHARACTER 8) is also located on the master board and is used for selecting the water tank profile. The DIP switches for DUMP BAR, REMOTE DRAIN, WATER LEVEL SENSOR, and PUMP COIL VOLTAGE are located behind the cover of the switch box 42. The Drain and Dump Bar valves may be either gravity or powered systems, each of which needs to have a different interaction with the pump controls.

For the example reference code 100 shown in FIG. 12, the settings are as follows:

Example Reference Code: 1 KB4C10CA

1—Uses the control box switch for Pump and Work Lights

K—Only has a Hose reel (no Auto function or Aux options)

B—Only has VSS and a Dump Bar (no Remote Drain)

4—Has four rear spray heads

C—Only monitor BFV (no Foam Agent or Adj. Nozzle)

1—Has a pressure Dump Bar

0—Has a gravity Drain

C—Tank is 150 inches tall

A—Electric/Hydraulic pump coil for pump operation requires only 5 volts

Exemplary switch setting configuration options for the switchbox 32 are shown below in Table 7.

TABLE 7

| DIP Switch Settings | | | | | | |
|---|---|---|---|---|---|---|
| SW1 | SW2 | SW3 | SW4 | SW5 | SW6 | FUNCTION |
| | | | | | | DRAIN TYPE SELECTION |
| OFF | | | | | | Gravity operated. No interaction with the pump. |
| ON | | | | | | Pump operated. DRAIN switch is interlocked to the pump timeout in the same manner as the spray heads. |
| | | | | | | DUMP BAR TYPE SELECTION |
| | OFF | | | | | Gravity operated. No interaction with the pump. |
| | ON | | | | | Pump operated. DMPBAR switch is interlocked to the pump timeout in the same manner as the spray heads. |
| | | | | | | PUMP VALVE DRIVE POWER SELECTION |
| | | OFF | OFF | | | CAT valve, limited to about 5 V RMS |
| | | ON | OFF | | | CAT 773 rigid frame valve., limited to about 1.93 A RMS |

TABLE 7-continued

| DIP Switch Settings | | | | | | |
|---|---|---|---|---|---|---|
| SW1 | SW2 | SW3 | SW4 | SW5 | SW6 | FUNCTION |
| | | OFF | ON | | | Komatsu valve, limited to 0.8 A RMS |
| | | ON | ON | | | Reserved for future use. |
| | | | | X | X | Reserved for future use. |

The PWM drive power to the pump valve ramps the pump up and down. Because there are several different valves in common use, the switch settings allow for selection of the appropriate drive power for the type of valve being used The firmware configures the system based on the DIP switch settings. The pin/switch assignments are:

C7-SW1: DRAIN type
OFF - Gravity only. Not interlocked to the pump controls.
ON - Powered. Fully interlocked to the pump controls.
C6-SW2: DMPBAR type
OFF - Gravity only. Not interlocked to the pump controls.
ON - Powered. Fully interlocked to the pump controls.
C5, 4-SW 3, 4: PUMP valve type

| SW4 (C4) | SW3 (C5) | Valve type |
|---|---|---|
| OFF | OFF | CAT valve, limited to about 5 V RMS |
| OFF | ON | CAT 773 rigid frame valve, about 1.93 amps RMS |
| ON | OFF | Komatsu valve, limited to 0.8 A per data sheet, measured on test bench |
| ON | ON | spare (not used at this time) |

C2 and C3 are used by the ISCS interface
C1, 0-SW5, 6: spares (unused)

these may end up being used to select options on the ISCS system

The pins use internal pull-ups to allow the state to be selected by the switches. This means that OFF (switch in open state) will result in the input line reading as a high (1). ON (switch closed) will result in the input line reading as a low (0).

Upon reading this disclosure, those skilled in the art will appreciate that various changes and modifications may be made to the preferred embodiments of the invention and that such changes and modifications may be made without departing from the spirit of the invention. Therefore, the invention in its broader aspects is not limited to the specific details, representative devices, and illustrative examples shown and described. Accordingly, departures may be made from such details without departing from the spirit or scope of the general inventive concept.

What is claimed is:

1. A system for controlling water distribution from an industrial water distribution vehicle, the system comprising:

a hydraulic control circuit of an industrial water distribution vehicle, wherein the hydraulic control circuit is configured to drive a water pump via a hydraulic motor;

one or more hydraulically controlled spray heads, each being configured to spray a water flow from the industrial water distribution vehicle, wherein the hydraulic control circuit includes a hydraulic control manifold and one or more hydraulic control lines configured to deliver a flow of hydraulic fluid to each of the one or more hydraulically controlled spray heads;

an actuator for turning the one or more hydraulically controlled spray heads on and off, wherein the actuator is configured to actuate one or more valves of the hydraulic control manifold that control the flow of hydraulic fluid to the one or more hydraulically controlled spray heads;

a computer processor programmed for providing a signal for controlling the actuator;

wherein the computer processor is configured to automatically provide the signal for controlling the actuator in response to at least one sensor input signal; and wherein the signal for controlling the actuator is pulse width modulated.

2. The system of claim 1 wherein the processor also is programmed to provide the signal for controlling the actuator in response to a manual input from an operator.

3. The system of claim 1 wherein the at least one sensor input signal is associated with a ground speed of the vehicle.

4. The system of claim 3 further comprising means for measuring the ground speed of the vehicle.

5. The system of claim 4 wherein the means for measuring the ground speed of the vehicle includes a GPS.

6. The system of claim 3 wherein the processor is programmed to prevent the water flow from at least one of the one or more spray heads when the ground speed of the vehicle is below a minimum speed.

7. The system of claim 3 wherein the processor is programmed to adjust the water flow from at least one of the one or more spray heads based on the ground speed of the vehicle.

8. A system for controlling water distribution from an industrial water distribution vehicle, the system comprising:

a water tank of an industrial water distribution vehicle, wherein the water tank is configured to store a quantity of water and the industrial water distribution vehicle includes a hydraulic control circuit configured to drive a water pump via a hydraulic motor;

wherein the hydraulic control circuit includes a hydraulic control manifold and one or more hydraulic control lines configured to deliver a flow of hydraulic fluid to a plurality of hydraulically controlled spray heads, each being configured to spray a flow of water from the quantity of water stored by the water tank;

an actuator for turning each of the plurality of the spray heads on and off, wherein the actuator is configured to actuate one or more valves of the hydraulic control manifold that control the flow of hydraulic fluid to the plurality of spray heads; and a computer network comprising a processor programmed for controlling the flow of water from the plurality of spray heads in response to at least one sensor input signal;

wherein the processor is programmed to control the flow of water from the plurality of the spray heads using pulse width modulation.

9. The system of claim 8 wherein the sensor input signal is associated with a ground speed of the vehicle.

10. The system of claim 9 wherein the processor is programmed to stop the water flow from the plurality of spray heads when the ground speed of the vehicle is below a minimum speed.

11. The system of claim 9 wherein the processor is programmed to adjust the water flow from at least one of the plurality of spray heads based on the ground speed of the vehicle.

12. The system of claim 9 wherein the processor is programmed to prevent the water flow from at least one of the plurality of spray heads as the ground speed of the vehicle is reduced.

13. The system of claim 8 wherein the processor is programmed to automatically turn off the water pump if a water level in the water tank is below a minimum level.

14. The system of claim 8 wherein the computer network includes a data bus.

15. The system of claim 14 wherein the data bus comprises a LIN bus.

16. A system for controlling water distribution from an industrial water distribution vehicle, the system comprising:

a water tank of an industrial water distribution vehicle, wherein the industrial water distribution vehicle includes a hydraulic control circuit configured to drive a water pump via a hydraulic motor;

a plurality of hydraulically controlled spray heads configured to receive a flow of water from the water tank and to spray the flow of water out of the industrial water distribution vehicle;

wherein the hydraulic control circuit includes a hydraulic control manifold and one or more hydraulic control lines configured to deliver a flow of hydraulic fluid to the plurality of hydraulically controlled spray heads; and wherein the water pump is configured to deliver the flow of water from the water tank to the plurality of spray heads at a water flow rate;

an actuator for turning the plurality of hydraulically controlled spray heads on and off, wherein the actuator is configured to actuate one or more valves of the hydraulic control manifold that control the flow of hydraulic fluid to the plurality of spray heads independently of the water flow rate; and a computer network comprising a processor programmed for controlling a water flow from the spray heads in response to an input signal associated with a ground speed of the vehicle;

wherein the processor is programmed for controlling the flow of water sprayed from the spray heads out of the industrial water distribution vehicle using pulse width modulation.

17. A system for controlling water distribution from an industrial water distribution vehicle, the system comprising:

a hydraulic control circuit of an industrial water distribution vehicle, wherein the hydraulic control circuit is configured to drive a water pump via a hydraulic motor;

one or more hydraulically controlled spray heads, each being configured to spray water from the industrial water distribution vehicle, wherein the hydraulic control circuit includes a hydraulic control manifold and one or more hydraulic control lines configured to deliver a flow of hydraulic fluid to each of the one or more spray heads to turn each of the one or more spray heads on and off;

an actuator for turning each of the one or more spray heads on and off, wherein the actuator is configured to actuate one or more valves of the hydraulic control manifold that control the flow of hydraulic fluid to each of the one or more spray heads; and a computer processor programmed for providing a control signal for controlling the actuator;

wherein the control signal includes a pulse width modulated signal having a duty cycle and a period; and wherein the computer processor is programmed to automatically vary the duty cycle and the period of the pulse width modulated signal in response to a ground speed of the vehicle.

18. The system of claim 17 wherein the computer is programmed to automatically provide the control signal as a pulse width modulated signal when the ground speed of the vehicle is in a range between a first threshold speed and a second higher threshold speed.

19. The system of claim 18 wherein the computer is programmed to automatically close off one or more of the spray heads when the ground speed of the vehicle is below the first threshold speed.

20. The system of claim 17 wherein the computer is programmed to automatically increase the duty cycle as the ground speed of the vehicle increases.

* * * * *